US008267247B1

(12) United States Patent
Horiyama

(10) Patent No.: US 8,267,247 B1
(45) Date of Patent: Sep. 18, 2012

(54) POWER TOOL STORAGE CASE

(75) Inventor: Toru Horiyama, Anjo (JP)

(73) Assignee: Makita Corporation, Anjo-Shi (JP)

( * ) Notice: Subject to any disclaimer, the term of this patent is extended or adjusted under 35 U.S.C. 154(b) by 0 days.

(21) Appl. No.: 13/446,593

(22) Filed: Apr. 13, 2012

(51) Int. Cl.
*B65D 85/28* (2006.01)

(52) U.S. Cl. ..... 206/373; 220/843; 220/848

(58) Field of Classification Search ..... 220/254.1, 220/254.3, 254.9, 836, 843, 844, 845, 848; 206/349, 372, 373
See application file for complete search history.

(56) References Cited

U.S. PATENT DOCUMENTS 5,271,501 A * 12/1993 Chen ..... 206/373
5,915,553 A * 6/1999 Brown et al. ..... 206/372
6,062,385 A * 5/2000 Cho ..... 206/373
6,105,767 A * 8/2000 Vasudeva ..... 206/372
6,905,015 B2 * 6/2005 Hernandez et al. ..... 206/45.24
7,246,556 B1 * 7/2007 Stoneberg et al. ..... 101/333
7,334,680 B2 * 2/2008 Cunningham et al. ..... 206/372
2002/0162842 A1 * 11/2002 Pangerc et al. ..... 220/524
2005/0161357 A1 * 7/2005 Allan et al. ..... 206/373

FOREIGN PATENT DOCUMENTS

JP A-2007-314221 12/2007

* cited by examiner

*Primary Examiner* — Jacob K Ackun
(74) *Attorney, Agent, or Firm* — Oliff & Berridge, PLC

(57) ABSTRACT

A power tool storage case for storing an electric power tool includes an open-topped main body having a storage portion capable of storing an electric power tool, a lid member having an end edge hingedly connected to an end edge of the main body, an outer surface facing upward when an opening of the main body is closed by the lid member, and a sub-storage portion formed in the outer surface of the lid member, and an outer lid for opening or closing the sub-storage portion and having an end edge hingedly connected to the end edge of the lid member, and another end edge engageable or disengageable with the lid member. The main body and the lid member are hingedly connected by at least one shaft, and the outer lid and the lid member are hingedly connected by the same shaft.

14 Claims, 12 Drawing Sheets

POWER TOOL STORAGE CASE

This application claims the benefit of Japanese Patent Application Numbers 2011-104552 filed on May 9, 2011, and 2011-169526 filed on Aug. 2, 2011, the entirety of which is incorporated by reference.

BACKGROUND OF INVENTION

1. Technical Field

The present invention relates to a power tool storage case for storing an electric power tool such as an impact driver and its accessories.

2. Background of Invention

In a known power tool storage case for storing an electric power tool such as an impact driver, an electric power tool and its accessories, such as replaceable bits, or a rechargeable electric power tool and its accessories, such as battery pack and battery charger, are all packed together, so that they can be stored and carried together. As an example, Japanese Laid-open Patent Application, Publication No. 2007-314221 discloses a power tool storage case including a main body in the shape of an open rectangular box and configured to store an electric power tool body and the like. A lid member having a shape similar to that of the main body is hingedly connected to the main body with end edges of the lid member and the main body facing each other. Latches are provided on other end edges of the lid member and the main body for locking or unlocking them. A sub-storage portion is provided at an outer surface of the lid member and configured to store small pieces including bits, and a outer lid (small cover) for opening or closing the sub-storage portion is hingedly connected.

However, according to the aforementioned conventional power tool storage case, the outer lid for opening or closing the sub-storage portion has thin-wall portions at one end edge thereof, which are folded to form hinge portions, and the outer lid is engageable with the lid member by inserting the hinge portions into corresponding recessed receiving portions formed in the lid member. This configuration of the conventional power tool storage case leads to low durability of the outer lid, and the repeated opening and closing operation of the outer lid may disadvantageously cause fatigue breakdown of the hinge portions.

In view of the above drawback of the prior art, it would be desirable to provide a power tool storage case which can prolong the service life of the hinge portions of the outer lid to improve the durability of the outer lid.

SUMMARY OF INVENTION

In accordance with the present invention as embodied and described herein as a first aspect, a power tool storage case for storing an electric power tool comprises an open-topped main body having a storage portion capable of storing an electric power tool, a lid member having an end edge hingedly connected to an end edge of the main body, an outer surface facing upward when an opening of the main body is closed by the lid member, and a sub-storage portion formed in the outer surface of the lid member, and an outer lid for opening or closing the sub-storage portion and having an end edge hingedly connected to the end edge of the lid member, and another end edge engageable or disengageable with the lid member, wherein the main body and the lid member are hingedly connected by at least one shaft, and the outer lid and the lid member are hingedly connected by the same shaft.

Preferably, in a second aspect, the power tool storage case according to the first aspect may be configured such that the lid member is shaped like a box and the outer surface thereof is positioned higher than the opening of the main body when the opening of the main body is closed by the lid member, and that the outer lid has extension portions extending along peripheral surfaces of the lid member in such a position that the sub-storage portion is closed by the outer lid.

Preferably, in a third aspect, the power tool storage case according to the first aspect or the second aspect may be configured such that the main body is provided with a latch configured to be engageable with the lid member to lock the lid member in such a position that the opening of the main body is closed by the lid member, and that the outer lid is provided with an engageable portion through which the latch is engageable with the outer lid in such a position that the opening and the sub-storage portion are closed, whereby the lid member and the outer lid can be simultaneously locked by the latch.

With the configuration of the power tool storage case according to the first aspect, the shaft for hingedly connecting the main body and the lid member is also used for the hinge connection with the outer lid. This can prolong the service life of the hinge portion of the outer lid to improve the durability of the outer lid.

With the configuration of the power tool storage case according to the second aspect, in addition to the advantageous effect of the first aspect, it is possible to suitably prevent rainwater and the like from entering the sub-storage portion, to thereby improve waterproof property and dust resistance of the power tool storage case.

With the configuration of the power tool storage case according to the third aspect, in addition to the advantageous effect of the first or the second aspect, the latch for locking the lid member can also lock the outer lid. Therefore, even if the repeated opening and closing operation of the outer lid results in wear in engageable means for closing the outer lid, the outer lid can be closed without fail.

Other and further objects, features and advantages of the present invention will appear more fully from the following description.

BRIEF DESCRIPTION OF DRAWINGS

To better understand the claimed invention, and to show how the same may be carried into effect, reference will now be made, by way of example only, to the accompanying drawings.

DETAILED DESCRIPTION OF INVENTION

With reference to the accompanying drawings, embodiments of the present invention will be described in detail.

Figure 1:
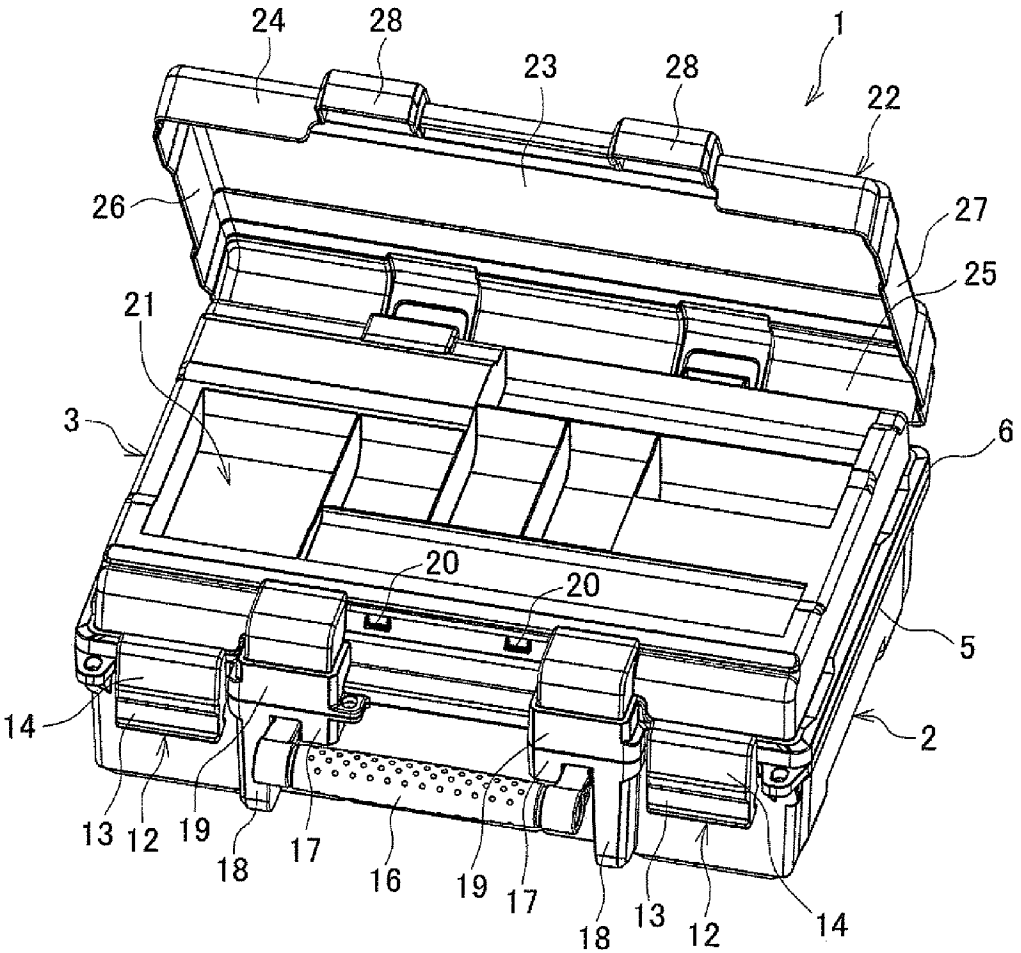
FIG. 1 is a perspective view of a power tool storage case with an outer lid being opened.
Figure 2:
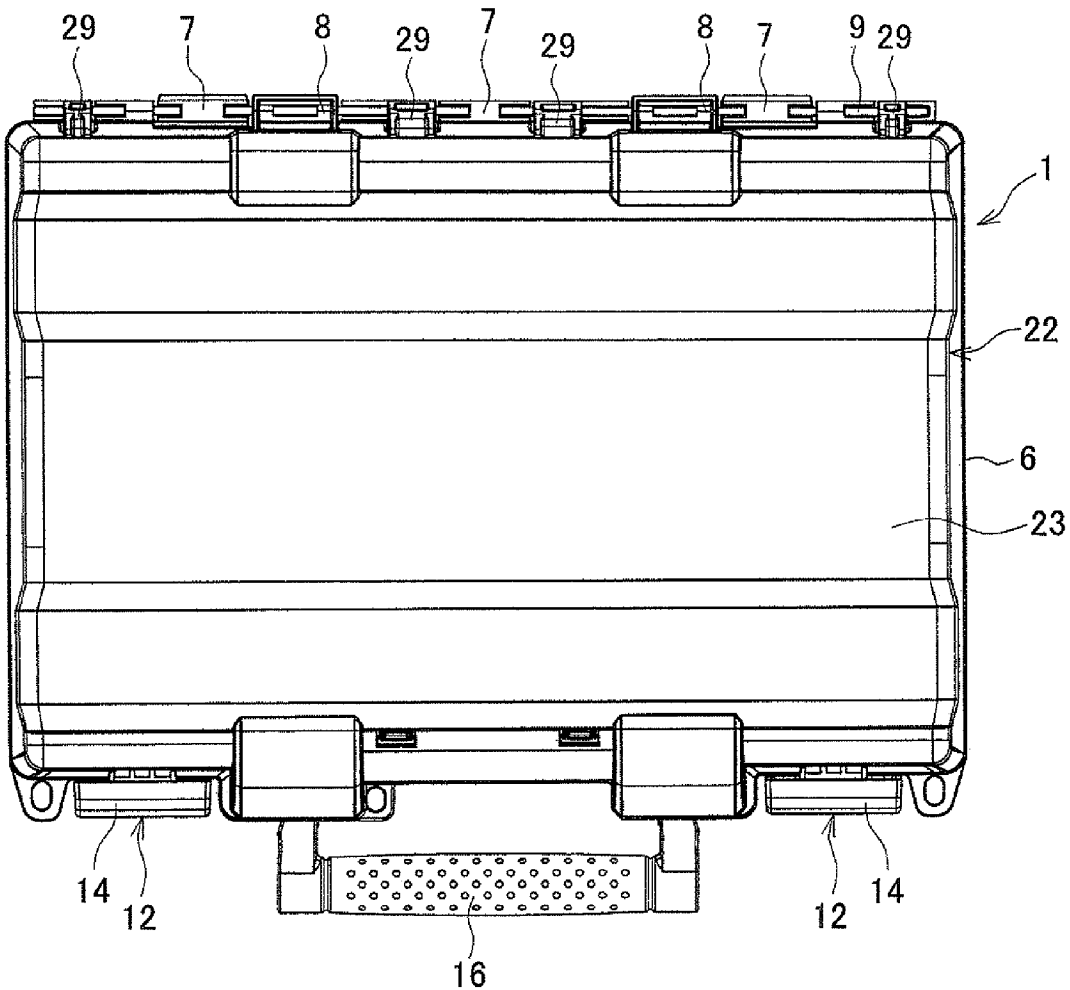
FIG. 2 is a top view of the power tool storage case.
Figure 3:
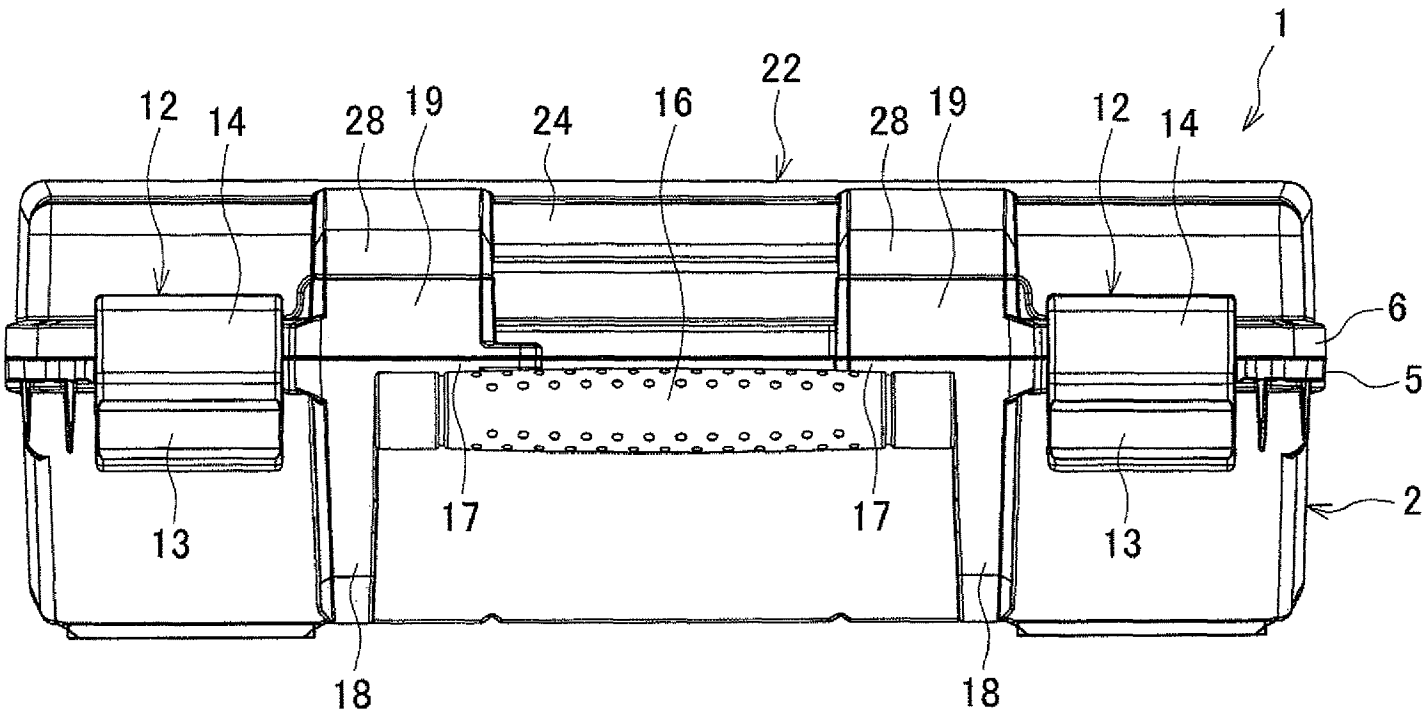
FIG. 3 is a front view of the power tool storage case.
Figure 4:
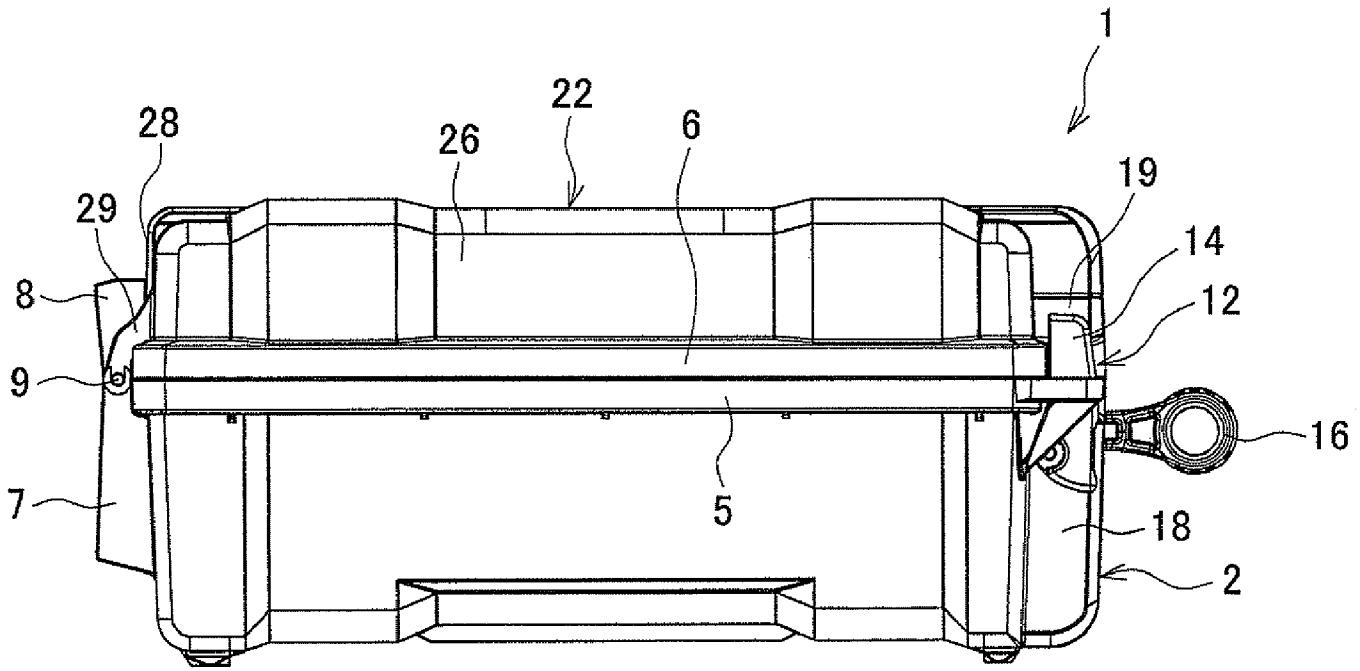
FIG. 4 is a left side view of the power tool storage case.

With reference to FIG. 1, a power tool storage case (hereinafter simply referred to as a storage case) is shown. The storage case 1 is made of synthetic resin and includes a main body 2 shaped like an open-topped rectangular box having a deep bottom, and a lid member 3 shaped like a similar open-topped rectangular box having a shallow bottom. In the main body 2, a storage portion 4 (see FIG. 5) is formed, in which an electric power tool body such as a rechargeable impact driver (not shown), a battery pack (not shown), a battery charger (not shown), and the like are stored. Outwardly extending band-like peripheral ribs 5, 6 are formed around peripheral surfaces of an opening of the main body 2 and an opening of the lid member 3, respectively, as seen in FIGS. 2 and 4, at rear end edges of the peripheral ribs 5, 6 (lower side of FIG. 1 and lower side of FIG. 2 correspond to the front side) main body hinge portions 7 and lid member hinge portions 8 are protrusively formed such that they are alternately arranged in a right-and-left direction when assembled together. The hinge portions 7, 8 are rotatably connected by a shaft 9 which extends in the right-and-left direction by alternately passing through the hinge portions 7, 8.

Figure 5:
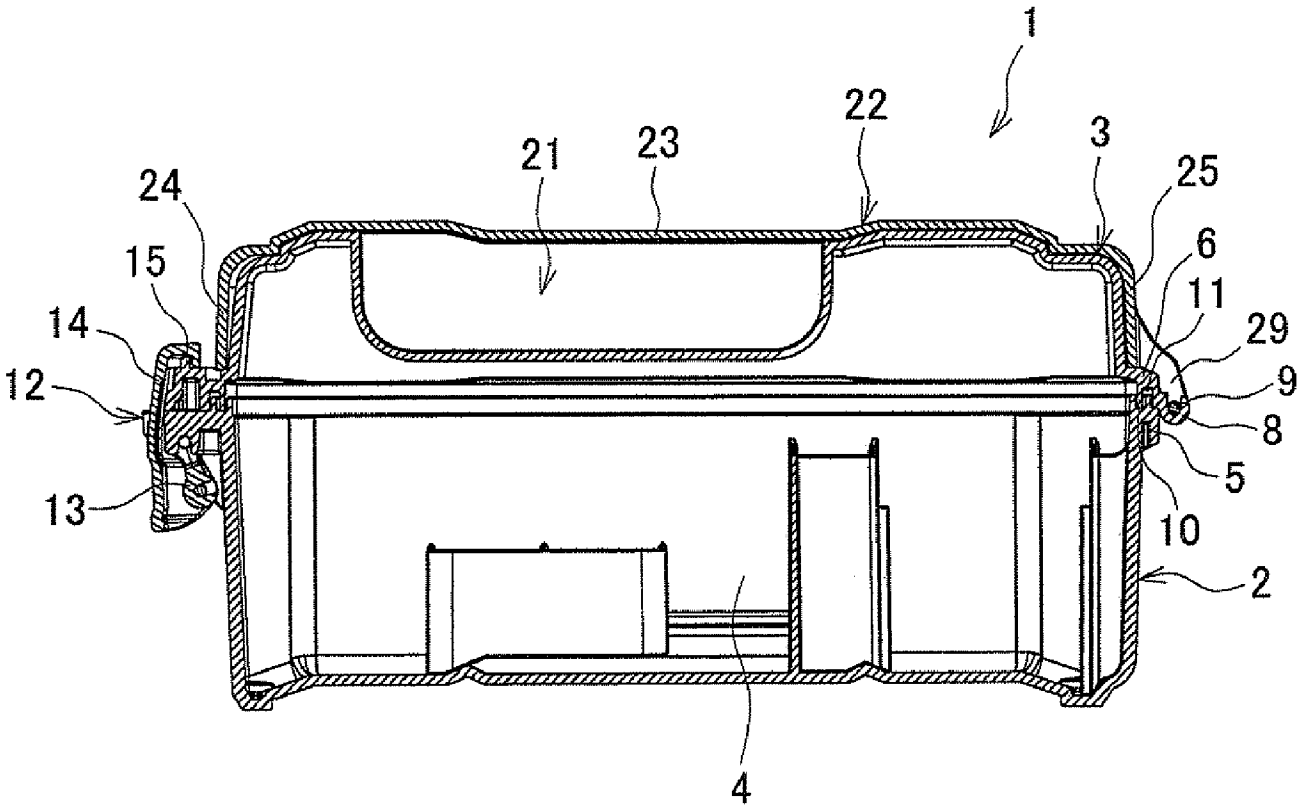
FIG. 5 is a vertical section passing through a latch portion of the power tool storage case.

The peripheral rib 5 of the main body 2 and the peripheral rib 6 of the lid member 3 are brought into contact at their entire perimeter when the lid member 3 is closed. As best seen in FIG. 5, an inner groove 10 is formed entirely in contacting surfaces of the peripheral rib 5 of the main body 2, and an outer groove 11 which is positioned outside the inner groove 10 is formed in contacting surfaces of the peripheral rib 6 of the lid member 3. When the peripheral ribs 5, 6 are brought into contact, the both grooves 10, 11 are engaged with each other to seal between the peripheral ribs 5, 6.

Front end surfaces of the main body 2 and the lid member 3 can be locked or unlocked by a pair of right and left latches 12. Each of the latches 12 is configured such that an upper end of a lever plate 13 is rotatably connected at an edge of the opening of the main body 2 and a hook plate 14 is rotatably connected at its lower end to the lever plate 13. Accordingly, while the upper end of the hook plate 14 is engaged with a projection 15 provided at an edge of the opening of the lid member 3, the lever plate 13 is flipped down so as to be parallel with the front face of the main body 2, so that the lid member 3 is engaged with and closes the main body 2. On the contrary, disengagement of the latch 12 is carried out by pulling up the lower end of the hook plate 14 to release the engagement of the hook plate 14.

The reference number 16 indicates a handle attached to the main body 2 between the latches 12. Both ends of the handle 16 are rotatably connected to a pair of right and left lower projections 17 which protrude frontward beyond the latches 12 held in a locked state, and in a state where the handle 16 is tilted down toward the front surface of the main body 2, the handle 16 does not protrude forward beyond the front surfaces of the lower projections 17. A pair of ribs 18 extending in the vertical direction are formed outside the both ends of the handle 16 that is tilted down, continuously from the pair of lower projections 17.

Further, a pair of right and left upper projections 19 are provided on the front surface of the lid member 3 in such positions that they form continuous profiles with the lower projections 17 of the main body 2 when the lid member 3 is closed. Provided between the upper projections 19 are a pair of engagement projections 20 formed on the front surface of the lid member 3.

The upper surface of the lid member 3 is recessed and divided into a plurality of spaces, which form a sub-storage portion 21 for storing small pieces including bits. Further, on the lid member 3, there is provided an outer lid 22 for opening or closing the upper surface of the sub-storage portion 21. The outer lid 22 is shaped like a rectangular dish comprising a rectangular-shaped upper plate portion 23 for covering the upper surface of the lid member 3 including the sub-storage portion 21, and four extension portions 24, 25, 26, 27 extending from four sides of the upper plate portion 23 and for covering front, rear, right and left peripheral surfaces of the lid member 3 while the peripheral rib 6 being exposed to view. Fitting portions 28 are formed on the front-side extension portion 24 such that they are fitted onto the upper projections 19 of the lid member 3 when the outer lid 22 is closed. Locking recess portions (not shown) are formed between the fitting portions 28 so that when the outer lid 22 is closed, the locking recess portions are elastically engaged with the locking projections 20 of the lid member 3.

Further, outer lid hinge portions 29 are protrusively formed on the rear-side extension portion 25 of the outer lid 22, and they are positioned between the lid member hinge portions 8 and the main body hinge portion 7 which is centrally located. The outer lid hinge portions 29 are connected by and rotatable around the shaft 9 which hingedly connects the main body 2 and the lid member 3. Accordingly, the main body 2, the lid member 3, and the outer lid 22 are hingedly connected together by the common shaft 9.

According to the storage case 1 as described above in this embodiment, when the outer lid 22 is closed with respect to the lid member 3, the upper surface of the lid member 3 including the sub-storage portion 21 is covered by the upper plate portion 23, and further the front, rear, right and left peripheral surfaces of the lid member 3 are also covered by the extension portions 24-27. Accordingly, even if the upper plate portion 23 is exposed to rainwater, the rainwater will run down along the outer surfaces of the extension portions 24-27. Therefore, rainwater is prevented from entering the sub-storage portion 21. Further, dusts are less likely to enter the sub-storage portion 21.

To open the outer lid 22 for taking out or putting away small pieces from or in the sub-storage portion 21, for example, a user holds the fitting portions 28 by his hands and flips up the front end surface of the outer lid 22. By this operation, as best seen in FIG. 1, the outer lid 22 rotates in an upward direction around the shaft 9 to open the sub-storage portion 21. In this opened state of the outer lid 22, the upper surface of the lid member 3 including the sub-storage portion 21 is entirely exposed, so that loading and unloading of the small pieces can be carried out without interfering with the outer lid 22. Further, since the outer lid 22 is also hingedly connected by the same shaft 9, the outer lid 22 can provide high durability and the repeated opening and closing operation is not likely to cause breakdown of the outer lid 22.

According to the storage case 1 in the above embodiment, the main body 2 and the lid member 3 are hingedly connected by the shaft 9, and the outer lid 22 and the lid member 3 are hingedly connected by the same shaft 9. Therefore, the service life of the outer lid hinge portions 29 can be prolonged and the durability of the outer lid 22 can be improved.

Especially in the above embodiment, the lid member 3 is shaped like a box and the outer surface thereof is positioned higher than the opening of the main body 2 when the opening of the main body 2 is closed by the lid member 3, and the outer lid 22 has extension portions 24-27 extending along the peripheral surfaces of the lid member 3 in such a position that the sub-storage portion 21 is closed by the outer lid 22. Therefore, it is possible to suitably prevent rainwater and the like from entering the sub-storage portion 21 to improve waterproof property and dust resistance of the storage case 1.

It should be noted that as long as the main body, the lid member, and the outer lid are hingedly connected together by at least one common shaft, the configuration, the number, and the position of the hinge portions for connecting the main body, the lid member, and the outer lid are not limited to those described in the above embodiment, and various changes and modification may be made where necessary. In the above embodiment, the three parts including the main body, the lid member, and the outer lid are hingedly connected together by one single shaft. As long as the three parts can be hingedly connected together, the shaft may be divided into a pair of right and left shafts for rotatably supporting the hinge portions of the three parts, respectively.

Further, the extension portions may be modified, for example, the length of each extension portion can be shortened as compared with one described in the above embodiment, the extension portions may be partly provided on the outer lid, for example, at positions corresponding to the front and rear surfaces of the lid member, instead of providing at four surrounding surfaces of the lid member, or the extension portions may be omitted.

The shape of the main body and the lid member is not limited to the rectangular shape, other shapes such as square and trapezoid may be used. Instead of the box-shaped lid member, a plate-like lid member may be used.

The other structures of the main body and the lid member are not limited to those described in the above embodiment. For example, the shape, the number, and the arrangement of the latches and the handle may be modified where necessary.

In the above embodiment, the outer lid 22 is closed by elastically engaging the locking recess portions formed on the reverse surface of the outer lid 22 with the locking projections 20 of the lid member 3. However, the repeated opening and closing operation of the outer lid 22 may result in wear in the locking recess portions and the locking projections 20, which results that the closing of the outer lid 22 may not be performed reliably and the outer lid 22 may unintentionally be opened. In order to overcome this drawback, a modified embodiment will be described below.

Figure 6:
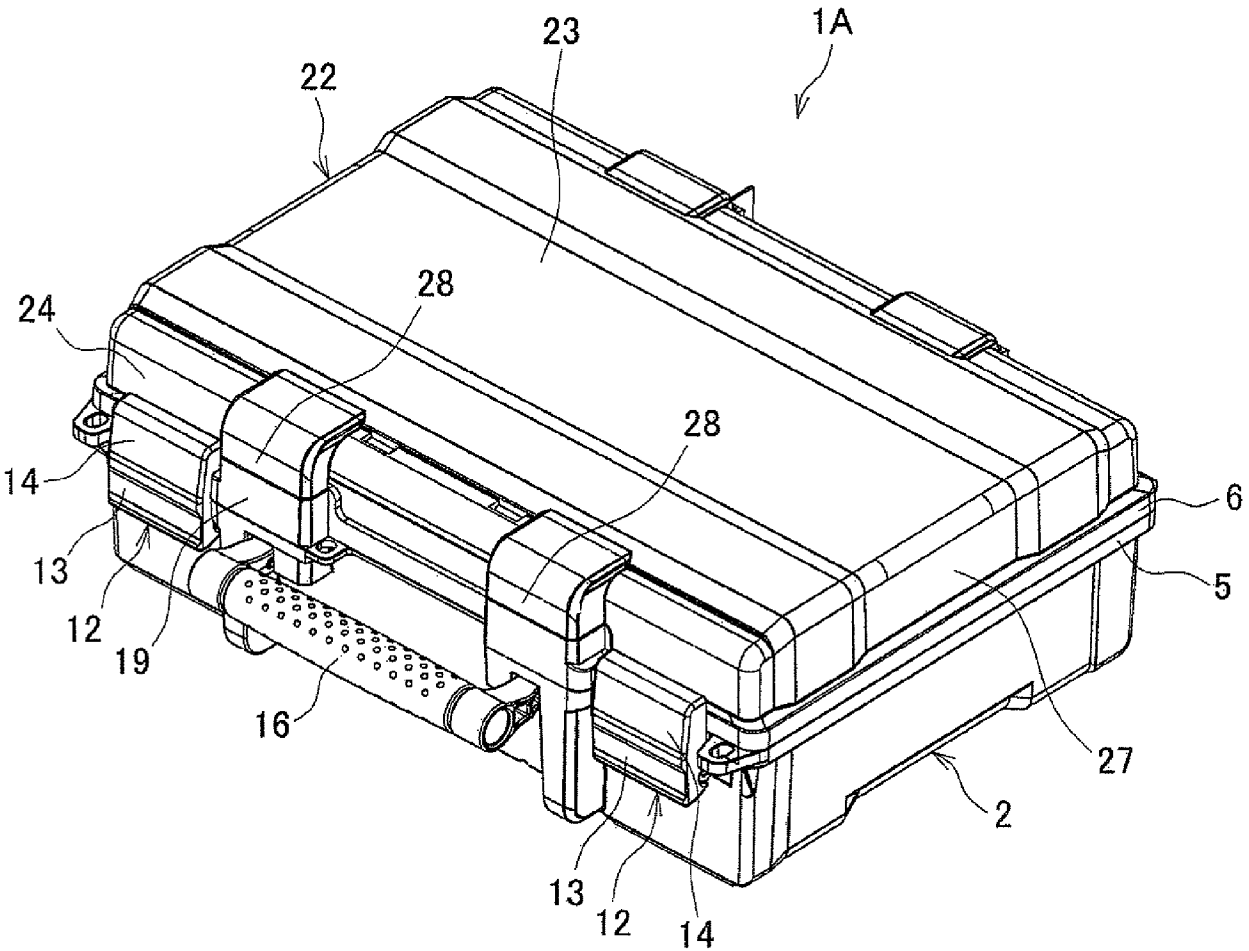
FIG. 6 is a perspective view of the power tool storage case according to a modified embodiment.
Figure 7:
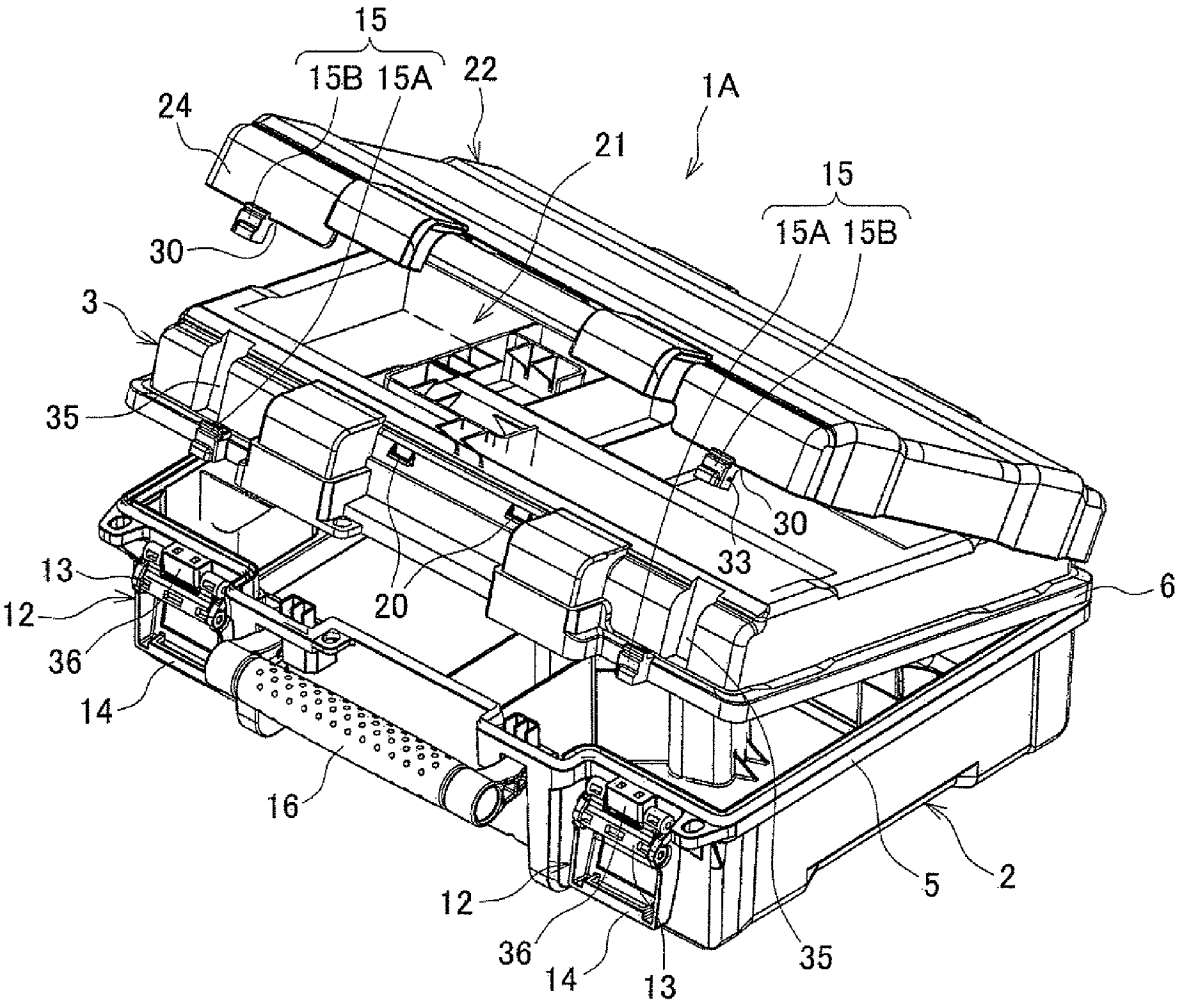
FIG. 7 is a perspective view of the power tool storage case according to the modified embodiment with the lid member and the outer lid being opened, wherein divided protrusions 15B are in use position.

According to a storage case 1A as seen in FIGS. 6 and 7, each of the right and left projections 15 used for engagement with the hook plate 14 of the corresponding latch 12 is divided into a pair of right and left portions as viewed from front, that is, a divided projection 15A and a divided projection 15B. The divided projections 15A are provided on the lid member 3, whereas the divided projections 15B are provided at the front end of the extension portion 24 of the outer lid 22.

Figure 8:
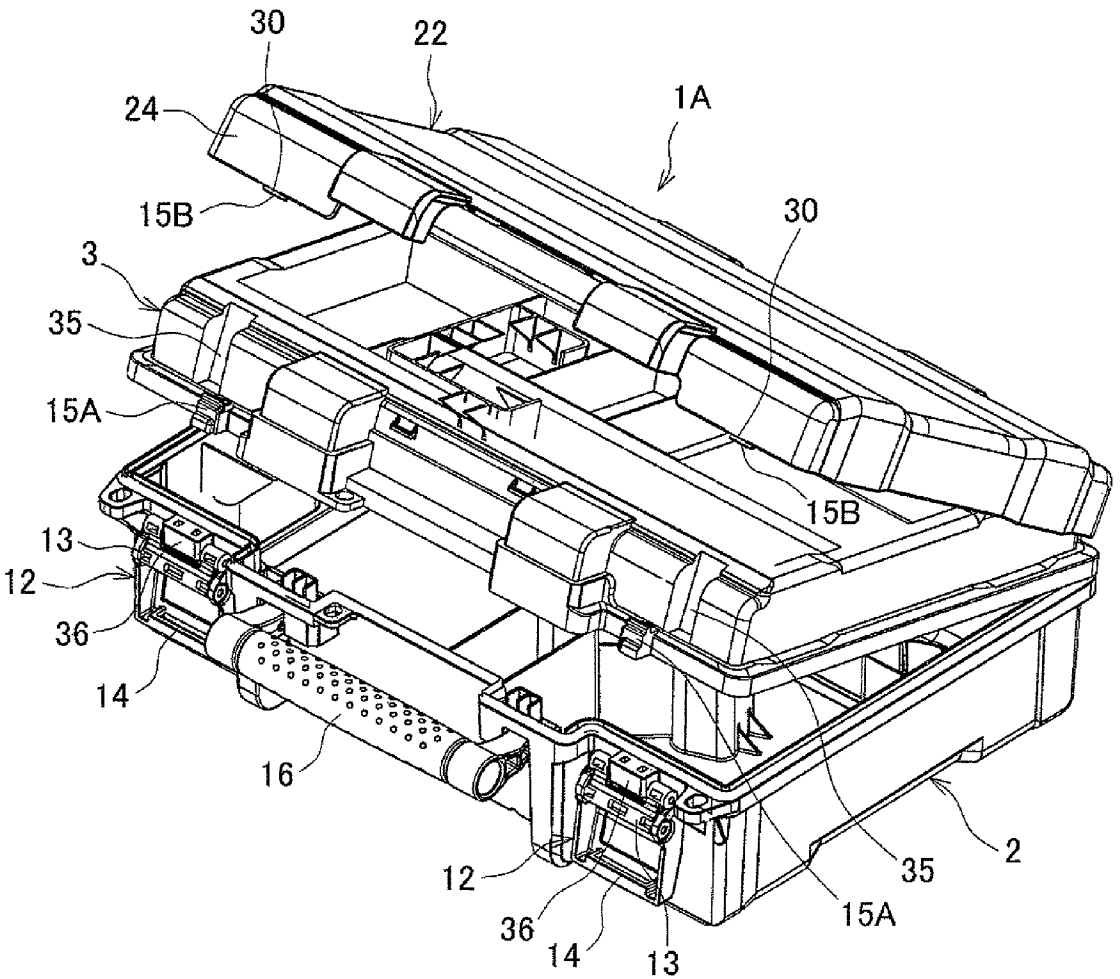
FIG. 8 is a perspective view of the power tool storage case according to the modified embodiment with the lid member and the outer lid being opened, wherein the divided protrusions 15B are in non-use position.
Figure 9:
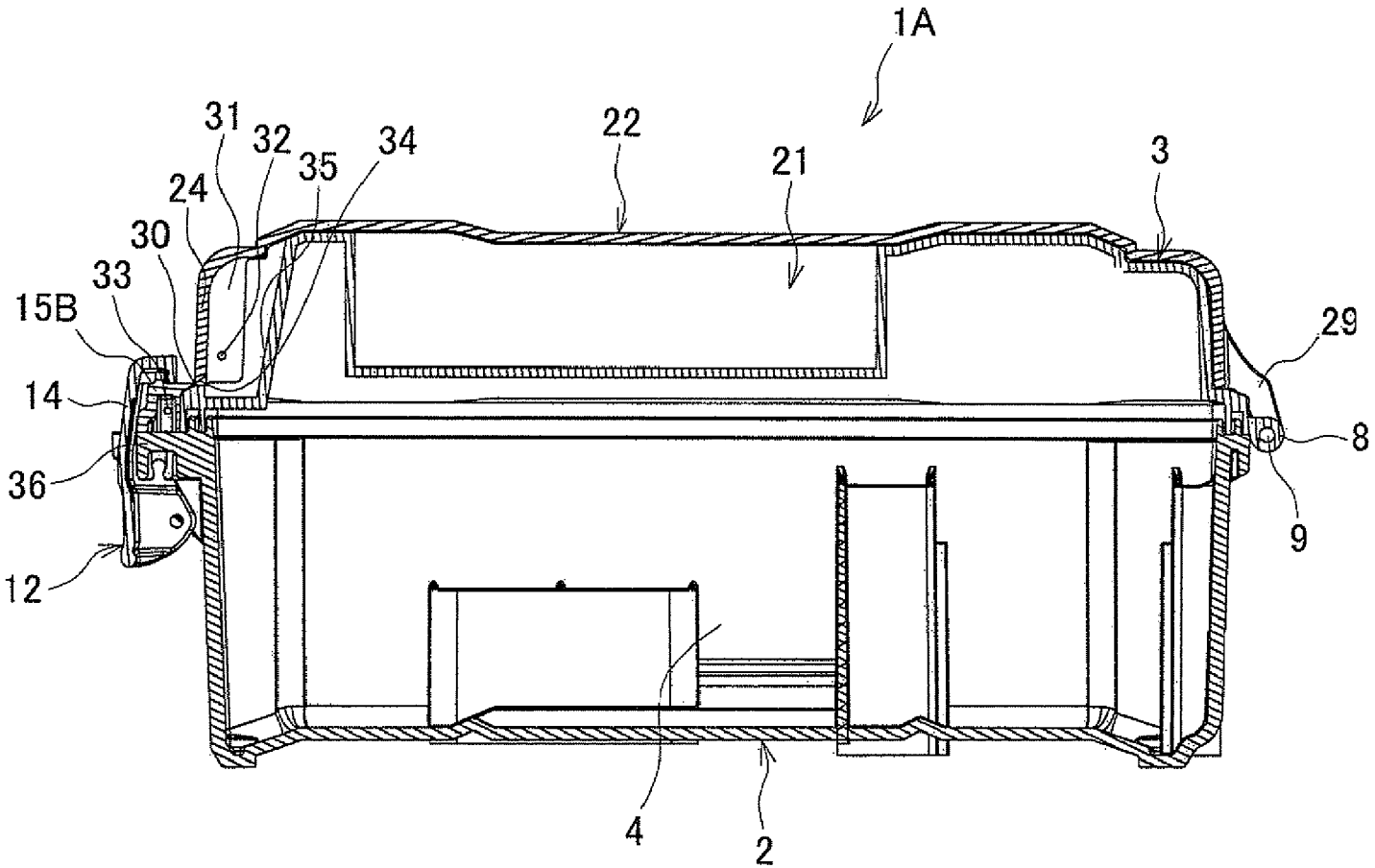
FIG. 9 is a vertical section of the power tool storage case according to the modified embodiment, passing through the latch portion, wherein the divided protrusions 15B are in the use position.

The divided projections 15B as engageable portions provided on the outer lid 22 are connected to the front end of the extension portion 24 through thin-walled hinges 30. Accordingly, each divided projection 15B is rotatable around the thin-walled hinge 30 between a use position as shown in FIG. 7 and a non-use position as shown in FIG. 8. In the use position, the divided projection 15B protrudes forward from the extension portion 24. In the non-use position, the divided projection 15B is retracted inside the extension portion 24 and does not protrude forward from the outer lid 22. As best seen in FIG. 9, engagement plates 31 (only one is shown in the figure) are provided on the inner surface of the extension portion 24. The engagement plates 31 are parallel to a side surface of the divided projection 15B. When the divided projection 15B is moved into the non-use position, a retaining projection 33 formed on a side surface of the divided projection 15B is elastically engaged with an engagement hole 32 formed in the engagement plate 31. Thus, the divided projection 15B is retained in the non-use position. A slanted surface 34 is formed at a lower end surface of the extension portion 24 where the thin-walled hinge 30 is provided such that the divided projection 15B can be rotated into the non-use position without interfering with the extension portion 24. In the front surface of the lid member 3, a pair of vertical grooves 35 are provided. The pair of divided projections 15B positioned in the non-use position can pass through the pair of vertical grooves 35 when closing the outer lid 22, so that interference of the divided projections 15B and the engagement plates 31 with the lid member 3 can be prevented.

According to this modified embodiment, with the divided projections 15B protruding into the use position, the sub-storage portion 21 is closed by closing the lid member 3 and the outer lid 22 together. Then, the pair of divided projections 15A of the lid member 3 and the pair of divided projections 15B of the outer lid 22 are arranged side by side and placed on a pair of corresponding rest portions 36, which are provided protrusively on the main body 2 at an edge of the opening and to which the lever plates 13 are rotatably connected. In this position of the divided projections 15A, 15B placed on the rest portions 36, when the user flips down the lever plates 13 with the upper end of each hook plate 14 being engaged with the divided projections 15A, 15B, as best seen in FIG. 9, the lid member 3 is locked to close the opening of the main body 2 and the outer lid 22 is also locked to close the sub-storage portion 21. In other words, the lid member 3 and the outer lid 22 can be locked together by the latches 12.

As described above, the outer lid 22 is provided with the divided projections 15B protrusively extending from the outer lid 22 and with which the latches 12 are engageable in such a position that the opening of the main body 2 and the sub-storage portion 21 are closed, and the lid member 3 and the outer lid 22 can be simultaneously locked by the latches 12. Therefore, even if the repeated opening and closing operation of the outer lid 22 results in wear in the locking recesses and the locking protrusions 20 as engageable means for closing the outer lid 22, the outer lid 22 can be closed without fail.

Figure 10:
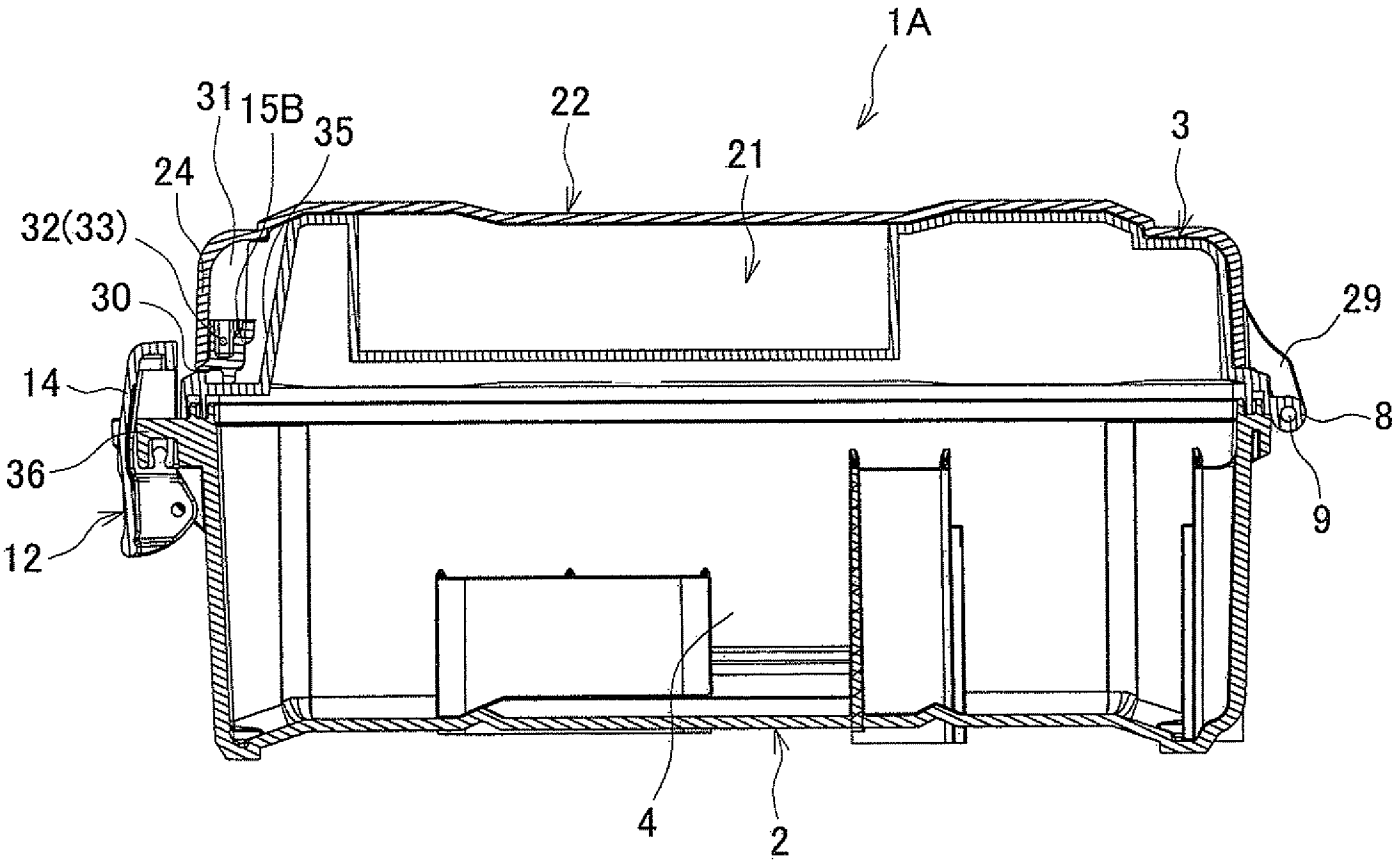
FIG. 10 is a vertical section of the power tool storage case according to the modified embodiment, passing through the latch portion, wherein the divided protrusions 15B are in the non-use position.

However, once the divided projections 15B are locked by the latches 12, the user is unable to open the outer lid 22 until after the latches 12 are unlocked. If the user wishes to open the outer lid 22 while the lid member 3 is being locked, as best seen in FIGS. 8 and 10, the user can move the divided projections 15B into the non-use position, so that only the divided projections 15A of the lid member 3 are locked by the latches 12 while allowing free movement of the outer lid 22. In order to move the divided projections 15B into the use position, the user can apply force to the divided projections 15B to rotate them in the forward direction, so that the retaining projection 33 of each divided projection 15B is disengaged from the engagement hole 32 of the engagement plate 31 and the divided projection 15B can be rotated in the forward direction.

In this modified embodiment, it is not necessary that the right and left divided projections 15A, 15B have the same shape, for example, the divided projections 15B of the outer lid 22 may be smaller in the width than the divided projections 15A of the lid member 3. Further, the divided projections 15A, 15B are not limited to ones which divide the projection 15 into two portions, for example, one of the divided portions may include a pair of spaced-apart divided projections and the other one of the divided portions may be a divided projection to be fitted between the pair of divided projections. Further, according to a storage case in which the outer lid 22 is not freely movable while the lid member 3 is being locked, the divided projections 15B may be non-rotatable and formed as stationary members protrusively extending from the extension portion 24.

Figure 11:
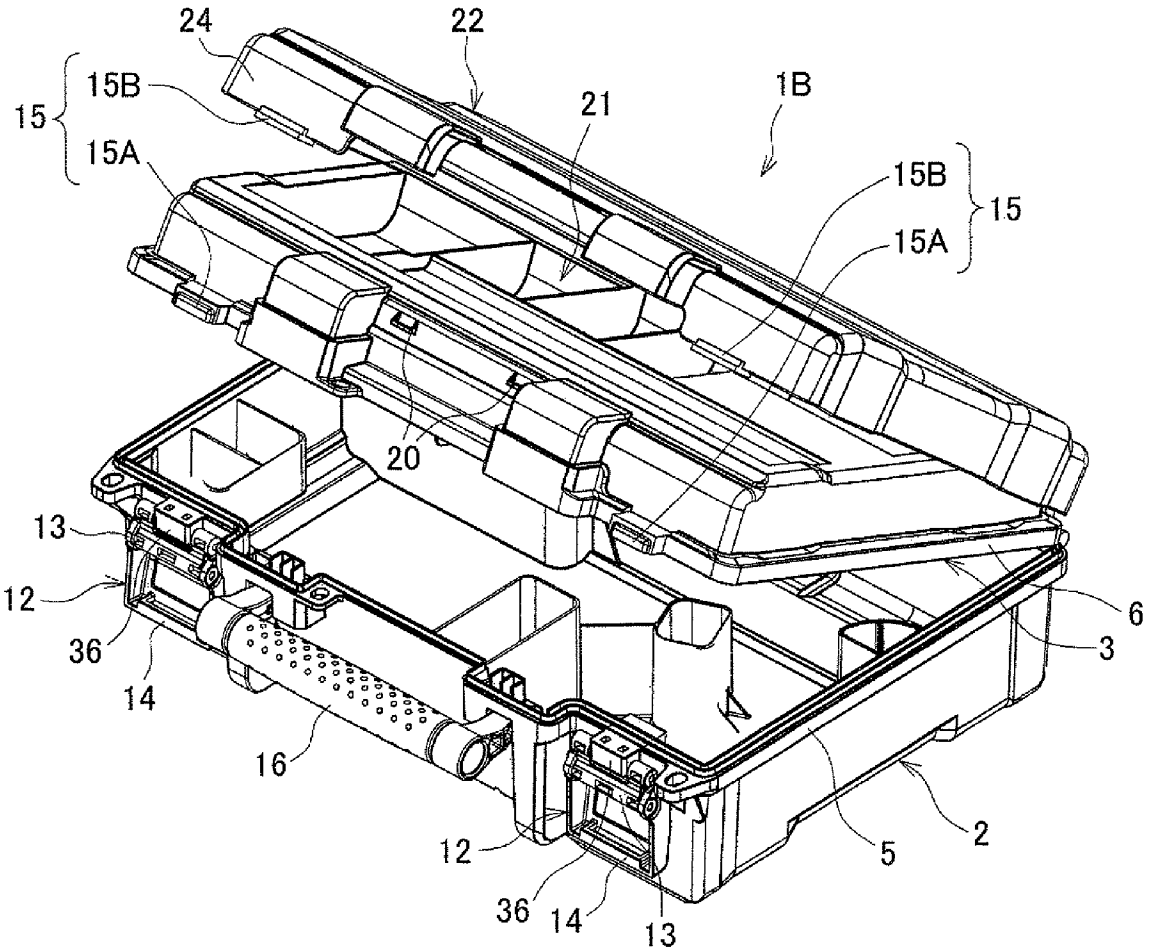
FIG. 11 is a perspective view of the power tool storage case according to another modified embodiment with the lid member and the outer lid being opened.
Figure 12:
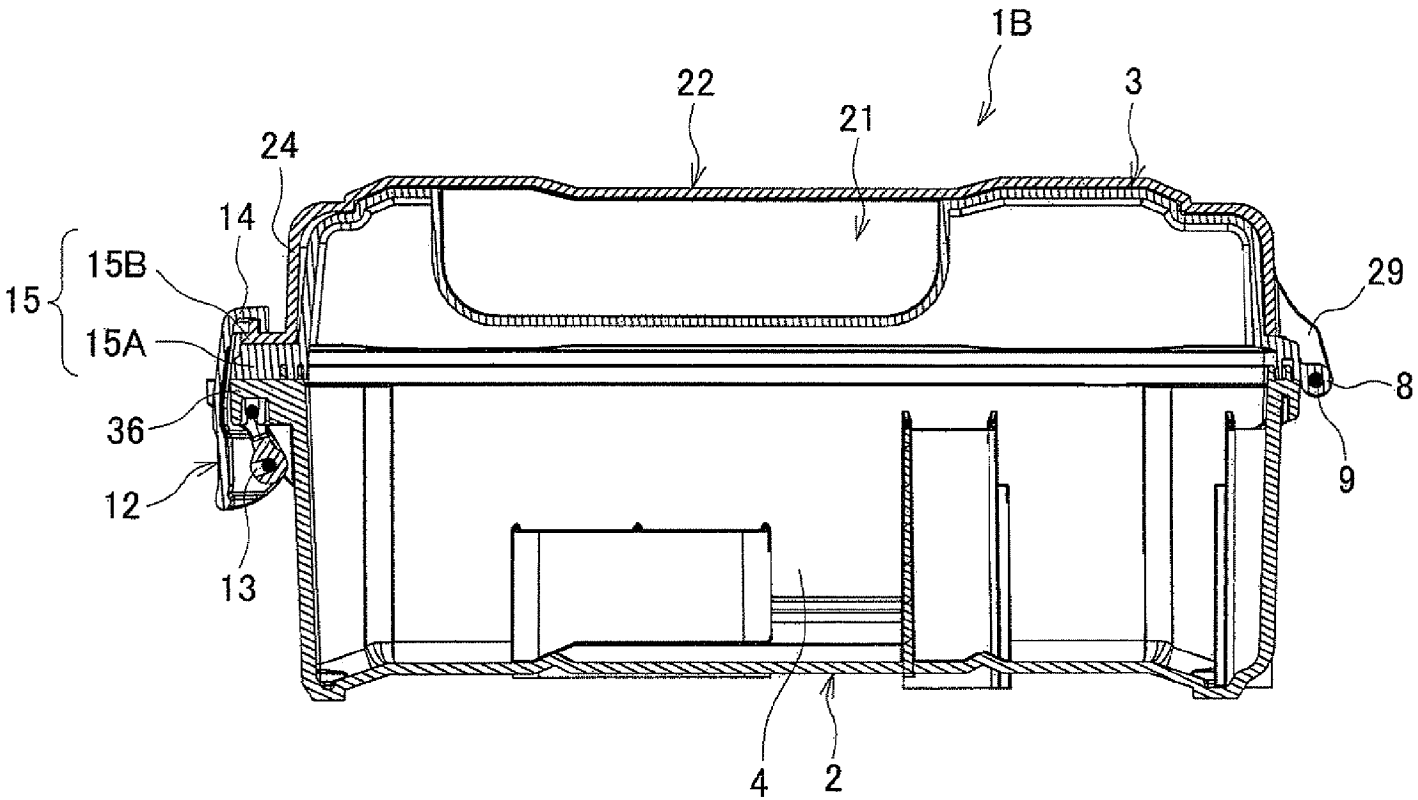
FIG. 12 is a vertical section of the power tool storage case according to the another modified embodiment, passing through the latch portion.

According to a storage case 1B shown in FIG. 11, instead of dividing each of the projection 15 into right and left divided projections, each projection 15 may divided vertically into two upper and lower projections, of which the divided projections 15A are provided on the lid member 3 and the other divided projections 15B as engageable portions are provided on the front end of the extension portion 24 of the outer lid 22. According to this storage case 1B, when the lid member 3 and the outer lid 22 are closed, the divided projections 15A of the lid member 3 and the divided projections 15B of the outer lid 22 are arranged vertically on the rest portions 36 to form a pair of projections 15. In this position of the lid member 3 and the outer lid 22, when the user flips down the lever plates 13 with the upper end of each hook plate 14 being engaged with the upper divided projection 15B, as best seen in FIG. 12, the lid member 3 and the outer lid 22 can be locked together in the closed state by the latches 12.

In the above modified embodiments, the projections of the lid member are divided to form the engageable portions of the outer lid. However, in accordance with the shape of the latches, the outer lid may have engageable portions extending along the corresponding non-divided projections of the lid member and engageable with the latches.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A power tool storage case for storing an electric power tool comprising:

an open-topped main body having a storage portion capable of storing an electric power tool;

a lid member having an end edge hingedly connected to an end edge of the main body, an outer surface facing upward when an opening of the main body is closed by the lid member, and a sub-storage portion formed in the outer surface of the lid member; and an outer lid for opening or closing the sub-storage portion and having an end edge hingedly connected to the end edge of the lid member, and another end edge engageable or disengageable with the lid member, wherein the main body and the lid member are hingedly connected by at least one shaft, and the outer lid and the lid member are hingedly connected by the same shaft.

2. The power tool storage case according to claim 1, wherein the lid member is shaped like a box and the outer surface thereof is positioned higher than the opening of the main body when the opening of the main body is closed by the lid member, and the outer lid has extension portions extending along peripheral surfaces of the lid member in such a position that the sub-storage portion is closed by the outer lid.

3. The power tool storage case according to claim 1, wherein the main body is provided with a latch configured to be engageable with the lid member to lock the lid member in such a position that the opening of the main body is closed by the lid member, and the outer lid is provided with an engageable portion through which the latch is engageable with the outer lid in such a position that the opening and the sub-storage portion are closed, whereby the lid member and the outer lid can be simultaneously locked by the latch.

4. The power tool storage case according to claim 3, wherein the engageable portion is movable between a use position where the latch is engageable with the engageable portion and a non-use position where the latch is unable to engage with the engageable portion.

5. The power tool storage case according to claim 4, further comprising a retaining means capable of retaining the engageable portion in the non-use position.

6. The power tool storage case according to claim 5, wherein the retaining means is configured such that a retaining projection provided on the engageable portion is elastically engaged with an engagement hole formed in the outer lid.

7. The power tool storage case according to claim 3, wherein the engageable portion is formed as a projection with which the latch is engageable, and the projection is divided into two divided projections, one of which is provided on the lid member and the other one which is provided on the outer lid.

8. The power tool storage case according to claim 7, wherein the projection is divided into right and left divided projections.

9. The power tool storage case according to claim 7, wherein the projection is divided into upper and lower divided projections.

10. The power tool storage case according to claim 1, wherein main body hinge portions provided on the end edge of the main body and lid member hinge portions provided on the end edge of the lid member are alternately arranged in line, outer lid hinge portions provided on the end edge of the outer lid are positioned between the main body hinge portions and the lid member hinge portions, and the main body hinge portions, the lid member hinge portions, and the outer lid hinge portions are hingedly connected by the same shaft.

11. The power tool storage case according to claim 1, wherein the main body has peripheral ribs around its opening and the lid member has peripheral ribs around its opening such that entire perimeter of the both peripheral ribs are brought into contact with each other when the lid member is closed.

12. The power tool storage case according to claim 11, wherein interengaging grooves are formed in the peripheral ribs of the main body and the peripheral ribs of the lid member at contacting surfaces thereof.

13. The power tool storage case according to claim 3, wherein the latch comprises a pair of right and left latches.

14. The power tool storage case according to claim 13, wherein a handle is attached to the main body between the latches.

* * * * *

UNITED STATES PATENT AND TRADEMARK OFFICE

CERTIFICATE OF CORRECTION

PATENT NO. : 8,267,247 B1
APPLICATION NO. : 13/446593
DATED : September 18, 2012
INVENTOR(S) : Toru Horiyama It is certified that error appears in the above-identified patent and that said Letters Patent is hereby corrected as shown below:

On the title page insert item:

--(30) Foreign Application Priority Data

May 9, 2011 (JP) 2011-104552
August 2, 2011 (JP) 2011-169526--

Signed and Sealed this
Twelfth Day of March, 2013

Teresa Stanek Rea
*Acting Director of the United States Patent and Trademark Office*